US006328298B1

(12) United States Patent
Suzuki et al.

(10) Patent No.: US 6,328,298 B1
(45) **Date of Patent: *Dec. 11, 2001**

(54) IMAGE FORMING APPARATUS AND FINISHER THEREFOR

(75) Inventors: Yuji Suzuki, Kanagawa; Masahiro Nakajima, Tokyo; Shigeru Horiguchi, Kanagawa, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,886

(22) Filed: Nov. 27, 1998

(30) Foreign Application Priority Data

Nov. 27, 1997 (JP) ..... 9-326269
Nov. 28, 1997 (JP) ..... 9-327456

(51) Int. Cl.[7] ..... B65H 33/04
(52) U.S. Cl. ..... 270/58.08; 270/58.02
(58) Field of Search ..... 270/58.02, 58.08, 270/58.11; 414/789

(56) References Cited

U.S. PATENT DOCUMENTS

| | | | | |
|---|---|---|---|---|
| 4,482,140 | * | 11/1984 | Macey | 270/58.08 |
| 4,905,054 | * | 2/1990 | Rood | 399/367 |
| 5,021,837 | * | 6/1991 | Uto et al. | 399/405 |
| 5,114,130 | * | 5/1992 | Hamanaka et al. | 270/58.11 |
| 5,172,179 | * | 12/1992 | Tani et al. | 399/408 |
| 5,241,355 | * | 8/1993 | Yamashita et al. | 399/407 |
| 5,320,336 | * | 6/1994 | Asami | 270/58.08 |
| 5,344,130 | * | 9/1994 | Suzuki et al. | 270/58.02 |
| 5,449,157 | * | 9/1995 | Kawano et al. | 270/53 |
| 5,473,420 | * | 12/1995 | Rizzolo et al. | 399/107 |
| 5,478,062 | * | 12/1995 | Horiuchi et al. | 270/58.08 |
| 5,590,871 | * | 1/1997 | Okabe et al. | 270/58.27 |
| 5,630,578 | * | 5/1997 | Naramore et al. | 270/58.08 |
| 5,709,376 | * | 1/1998 | Ushirogata | 270/58.11 |
| 5,724,641 | * | 3/1998 | Shojo et al. | 399/410 |
| 5,738,346 | * | 4/1998 | Ishida | 270/58.07 |
| 5,788,229 | * | 8/1998 | Asami et al. | 271/305 |
| 5,797,596 | * | 8/1998 | Morigami et al. | 270/58.11 |
| 5,826,158 | * | 10/1998 | Hirano et al. | 399/410 |
| 5,881,352 | * | 3/1999 | Kobayashi et al. | 399/408 |
| 5,971,383 | * | 10/1999 | Horikawa et al. | 270/58.11 |
| 6,022,011 | * | 2/2000 | Hirose | 270/37 |
| 6,027,107 | * | 2/2000 | Natsume et al. | 270/37 |

FOREIGN PATENT DOCUMENTS

| | | |
|---|---|---|
| 64-60561 | 3/1989 | (JP) . |
| 4-276495 | 10/1992 | (JP) . |
| 7-47783 | 2/1995 | (JP) . |
| 7-96685 | 4/1995 | (JP) . |
| 8-337352 | 12/1996 | (JP) . |

* cited by examiner

*Primary Examiner*—Christopher P. Ellis
*Assistant Examiner*—Richard Ridley
(74) *Attorney, Agent, or Firm*—Oblon, Spivak, McClelland, Maier & Neustadt, P.C.

(57) ABSTRACT

A finisher for an image forming apparatus of the present invention includes a path for conveying a stapled paper stack and located at a high level so as to reduce the length of a path preceding the above path. This reduces the possibility of a paper jam in the finisher and operation time. A tray included in the finisher is located at a high level in accordance with the height of the path assigned to a stabled paper stack. The tray can therefore be located at a position allowing the operator to pick up papers in a natural position. A guide guides the staple cassette into and out of the stapler body alone. Such a simple configuration insures the accurate insertion and removal of the staple cassette.

6 Claims, 6 Drawing Sheets

IMAGE FORMING APPARATUS AND FINISHER THEREFOR

BACKGROUND OF THE INVENTION

The present invention relates to a copier, facsimile apparatus, printer or similar image forming apparatus and more particularly to a sorter, stapler, stapler with a sorter or similar finisher for use with an image forming apparatus.

A finisher is extensively used with an image forming apparatus for sorting, stapling or otherwise finishing papers or similar recording media formed with images. The finisher is usually mounted to one side of the image forming apparatus in an upright position and stands on the floor as the image forming apparatus.

To meet the increasing demand for a compact configuration, the above floor type finisher is reduced in height as far as possible and has its finishing section positioned in the vicinity of the floor. Papers formed with images are sequentially transferred from the image forming apparatus to the finisher. The papers are finished by the finisher while being conveyed through a preselected conveyance path and then driven out to a tray.

To reduce the possibility of a paper jam and required operation time, the conveyance path of the finisher should preferably be as short as possible. However, it is difficult to reduce the length of the conveyance path against the trend toward a floor type finisher and a compact configuration. In addition, the compact configuration requires the level of the tray to be lowered and therefore forces the operator to pick up the stapled papers in a bent position. Should the tray be positioned at a high level in order to solve the above problem, the length of the conveyance path would increase and would thereby aggravate the possibility of a paper jam and operation time.

On the other hand, a stapler is often arranged below the conveyance path in relation to path arrangements in the image forming apparatus and finisher. Generally, a staple cassette loaded with staples is removably mounted to the body of the stapler and replenished with staples, as needed. To mount, or dismount the cassette to or from the stapler body, the inside of the finisher is opened to the outside. However, the stapler is, in many cases, positioned below the conveyance path in the finisher, making it difficult to mount And dismount the staple cassette. Particularly, when the operator cannot see the position of the stapler body for mounting the cassette, the operator is apt to turn the cassette up side down and try to mount it to the stapler body, resulting in time—and labor—consuming work. Moreover, if the operator cannot determine whether or not the cassette has been accurately mounted, then the operator is likely to cause the finisher to operate together with the image forming apparatus even when the position of the cassette is not correct. This would bring about staple jams and other troubles and would obstruct repair.

Technologies relating to the present invention are also disclosed in, e.g., Japanese Patent Laid-Open Publication Nos. 64-60561, 4-276495, 7-47783, 7-96685, and 8-337352.

SUMMARY OF THE INVENTION

It is therefore an object of the present invention to provide an image forming apparatus capable of reducing the length of a paper conveyance path and therefore the possibility of a paper jam while reducing the operation time, and a finisher therefor.

It is another object of the present invention to provide an image forming apparatus allowing the operator to pick up finished paper stacks in a natural position, and a finisher therefor.

It is a further object of the present invention to provide an image forming apparatus allowing a staple cassette to be surely and easily mounted and dismounted with a simple construction, and a finisher therefor.

In accordance with the present invention, a finisher capable of being mounted to an image forming apparatus includes a first path for conveying consecutive papers before finishing, and a second path for discharging a stack of papers after finishing. The second path is positioned at a level higher than a preselected level in the direction of height of the image forming apparatus while maintaining a preselected length. The first path is reduced in length in accordance with the level of the second path.

Also, in accordance with the present invention, in an image forming apparatus including a stapler for stapling a stack of papers formed with imaged, the stapler includes a body, a staple cassette removably mounted to the body and landed with staples for stapling the stack of papers, and a guide for guiding the staple cassette into and out of the body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
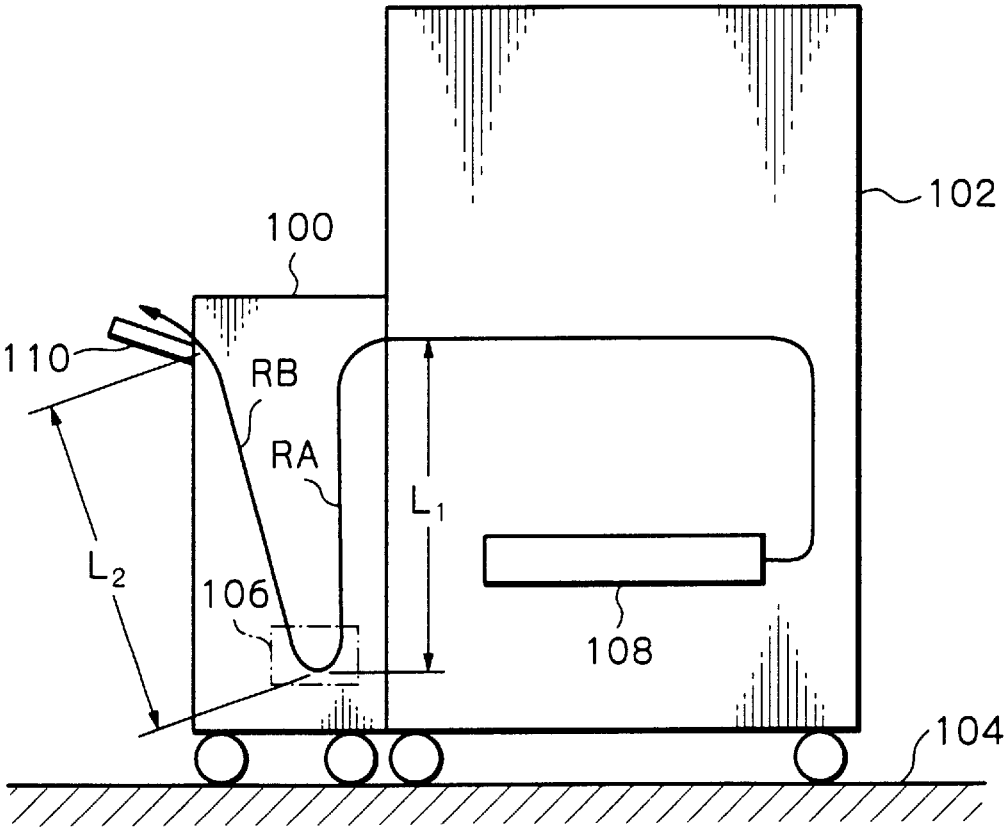
Fig. 1 PRIOR ART
FIG. 1 shows a conventional finisher mounted to an image forming apparatus.

To better understand the present invention, brief reference will be made to a conventional image forming apparatus with a finisher, shown in FIG. 1. As shown, a finisher 100 is mounted to one side of an image forming apparatus 102. The finisher 100 stands upright on a floor 104 on which the image forming apparatus 102 is situated. To meet the increasing demand for a compact configuration, the finisher 100 is reduced in height as far as possible and has its finishing section positioned 106 arranged in the vicinity of the floor 104.

A paper cassette 108 is disposed in the image forming apparatus 102 and loaded with a stack of papers. A paper fed from the cassette 108 is sequentially routed through an image forming station and a fixing station in the conventional manner. The paper formed with an image is driven out of the apparatus 102 and introduced into the finisher 100. In the finisher 100, the paper is conveyed through a path RA to a path RB and stacked and positioned on the path RB. At the finishing section 106, a stapler staples such a stack of papers sequentially brought to the path RB. A lifting mechanism, not shown, drives the stapled stack out of the path RB onto a tray 110.

To reduce the possibility of a paper jam and required operation time, the paper conveyance path in the finisher 100 should preferably be as short as possible. As for the path RB, there is little room for the reduction of length because the path RB plays the role of a tray for stacking and positioning the papers. On the other hand, the path RA is used only to convey the papers to the path RB and can have its length $L_1$ reduced without effecting the function of the finisher 100. However, it is difficult to reduce the length of the conveyance path against the trend toward a floor type finisher and a compact configuration.

Another problem with the conventional floor type finisher 100 is that the compact configuration requires the level of the tray 110 to be lowered and therefore forces the operator to pick up the stapled papers in a bent position. Should the tray 110 be positioned at a high level in order to solve the above problem, the length $L_2$ of the path RB would increase and would thereby aggravate the paper jam and operation time problem.

Figure 2:
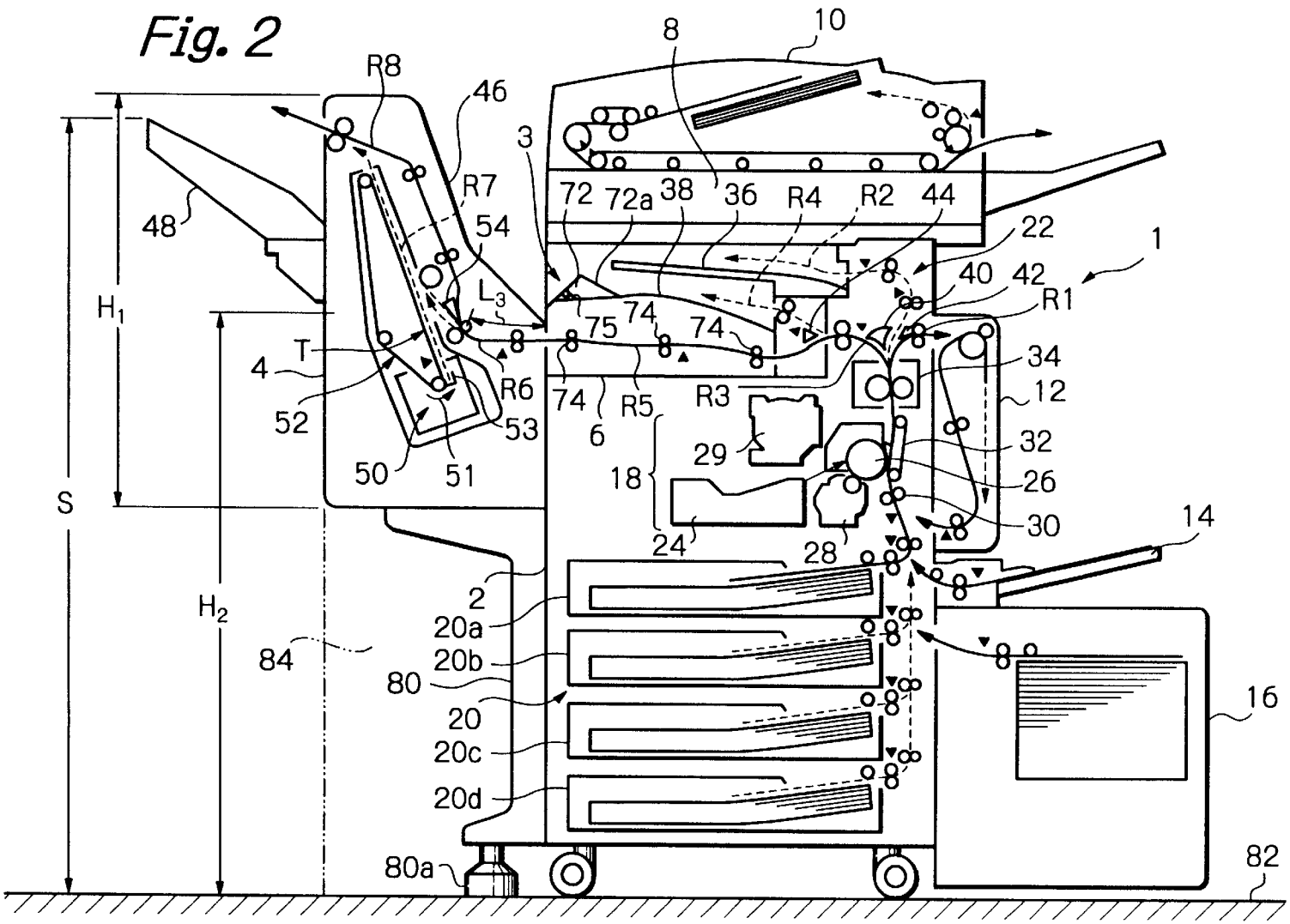
FIG. 2 is a section showing a finisher embodying the present invention and an image forming apparatus to which the finisher is mounted.

Referring to FIG. 2, a finisher embodying the present invention and an image forming apparatus to which it is mounted will be described. As shown, the image forming apparatus, generally 1, includes an apparatus body 2. A finisher 4 is mounted to the left side of the apparatus body, as viewed in FIG. 2. Transfer conveying means 6 is arranged in the apparatus body 2 for transferring papers sequentially driven out of the apparatus body 2 to the finisher 4. A scanner 8 is positioned on the top of the apparatus body 2. An ADF (Automatic Document Feeder) 10 is mounted on the apparatus body 2 above the scanner 8. An automatic duplex made unit 12 is arranged at the side of the apparatus body 2 opposite to the side where the finisher 4 is present. Also included in the apparatus are a manual feed tray 14 and a mass paper feed tray 16.

The transfer conveying means 6 includes a tray 38 forming the top of the conveying means 6. The apparatus body 2 has a space 3 delimited by the tray 38 and the underside of the scanner 8 at its bottom and top, respectively. The space 3 is open to the outside at the front side, as seen in the direction perpendicular to the sheet surface of FIG. 2, and at the left side. An inner tray 36 is positioned in the space 3 above the tray 38. An operation panel, not shown, is mounted on the front side of the scanner 8, as seen in the above direction. The scanner 8 and ADF 10 each has a conventional configuration and will not be described specifically. In FIG. 2, a number of solid triangles are representative of paper sensors.

In the apparatus body 2, an image forming section 18 is positioned at the canter while a paper feed section 20 and a paper discharge section 22 are respectively positioned below and above the image forming section 18 (so-called vertical transport path structure). An image is formed on a paper being conveyed upward in the substantially vertical direction along the side of the apparatus body 2 where the automatic duplex mode unit 12 is located.

In the image forming section 18, a writing unit 24 electrostatically forms a latent image on a photoconductive drum 26 in accordance with image data received from the scanner 8 or a personal computer not shown. A developing unit 28 develops the latent image with toner. The reference numeral 28 designates a device for replenishing a developer to the developing unit 28.

Papers of a size automatically selected or selected by the operator are sequentially fed from one of a plurality of cassettes 20*a*, 20*b*, 20*c* and 20*d* included in the paper feed section 20. Each paper is conveyed to an image transfer station by a registration roller 30 such that its leading edge meets the leading edge of a toner image formed on the drum 26. Image transferring means 32 is located at the image transfer station for transferring the toner image from the drum 26 to the paper. A fixing unit 34 fixes the toner image on the paper. The paper with the fixed toner image is conveyed to the paper discharge section 22.

The paper discharge section 22 has three different discharge routes R1, R2 and R3. The route R1, indicated by a solid line in FIG. 2, extends to the automatic duplex mode unit 12. The route R2, indicated by a dotted line, is arranged above the transfer conveying means 6 and extends to the inner tray 36. The route R3, indicated by a solid line, extends to the transfer conveying means 6. Path selectors 40 and 42 are used to select either one of the routes R1 and R2. In addition, the path selector 40 is used to select the route R3.

The paper brought to the automatic duplex mode unit 12 along the route R1 is switched back in the unit 12 and then conveyed to a substantially vertical path at a position short of the registration roller 30. When the paper is fed from the manual feed tray 14 or the mass paper feed tray 16, it is introduced into the substantially vertical path in the direction indicated by an arrow.

The route R3 extending to the transfer conveying means 6 branches into two routes R4 and R5 indicated by a dotted line and a solid line, respectively. The route R4 extends to the tray 38 forming the op of the transfer conveying means 6. The route P5 extends to the finisher 4 via a path defined in the transfer conveying means 6. A path selector 44 is disposed in the transfer conveying means 6 for selecting either one of the routes R4 and R5.

Figure 3:
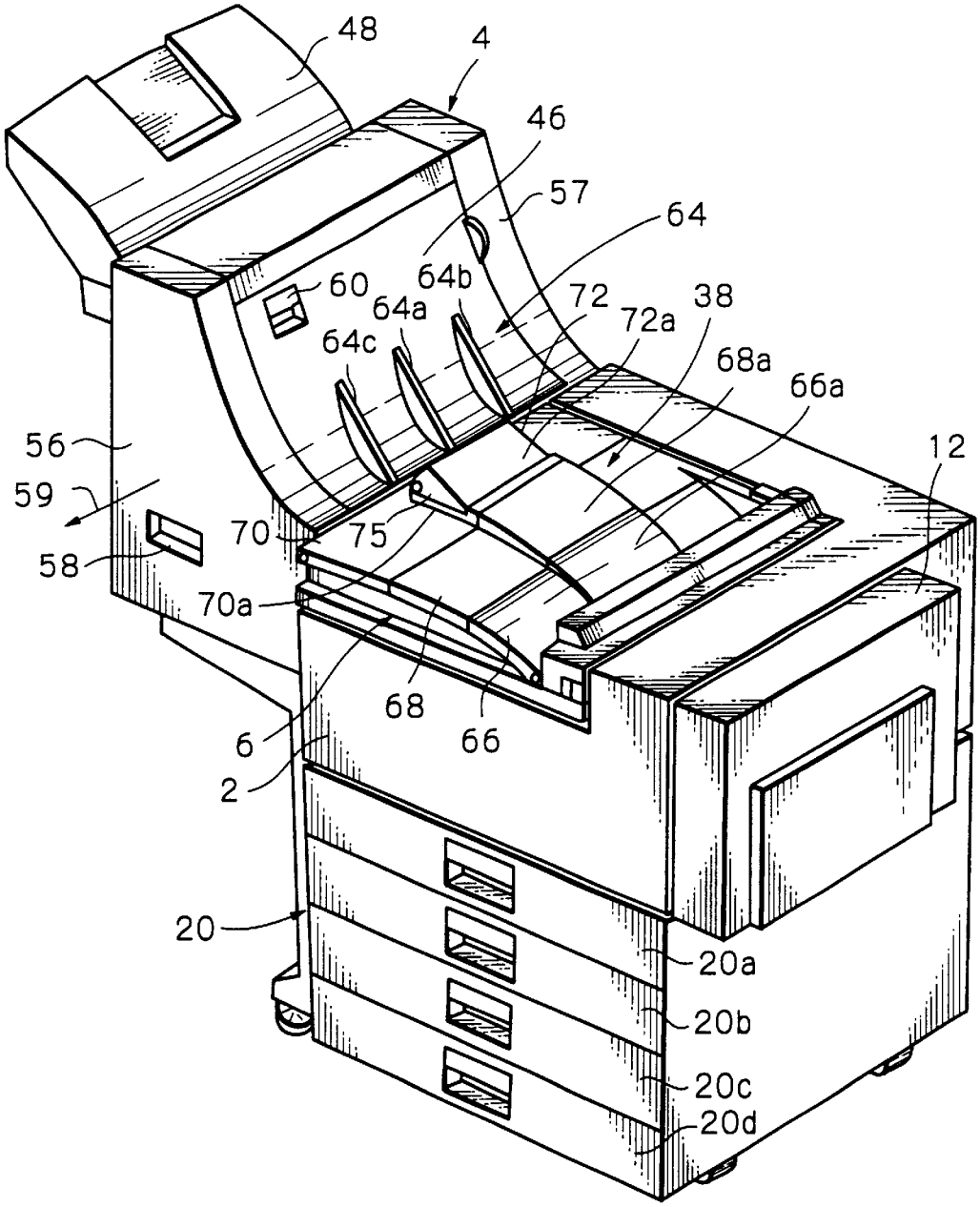
FIG. 3 is a perspective view of the finisher and image forming apparatus shown in FIG. 2.

As shown in FIG. 3, the finisher 4 includes opposite side covers 56 and 57 and an openable top cover 46 with a catch 60. The top cover 46 is an extension of the tray 38. When the length of the paper in the direction of paper discharge is greater than a preselected length, the top cover 46 serves as a part of the tray 38, The side cover 56 also has a catch 58, so that the operator can pull out the internal arrangement of the finisher 4 together with the side cover 56 in the direction indicated by an arrow 59. After pulling out the internal arrangement of the finisher 4, the operator may set staples or perform any other desired operation. The scanner 8 and ADF 10 are not shown in FIG. 3.

The top cover 46 has a curved surface in order to smoothly guide the leading edge of the paper. Narrow ribs 64 are formed on the top cover 46 and elongate in the direction of paper discharge, so that the paper is partly spaced above the top cover 46; otherwise, the paper would fully contact the cover 46 and would be conveyed in a defective condition. Specifically, in the illustrative embodiment, three ribs 64*a*, 64*b* and 64*c* are arranged side by side in order to prevent the paper from yielding in the widthwise direction (perpendicular to the direction of paper discharge).

Covers 66, 68 and 70 cover the top of the transfer conveying means 6, i.e., tray 38. The front and rear covers 66 and 70 each is hinged at one end and rotatable upward so as to facilitate the removal of a jamming paper. The cover 66 positioned at the upstream side in the direction of paper discharge is inclined downward toward the upstream side, so that the paper can return due to its own weight. The covers 86, 69 and 70 respectively include projections 66*a*, 68*a* and 70*a* reducing, like the ribs 64, the resistance between the paper and the tray 38. An auxiliary tray 72 is mounted on the projection 70*a* and rotatable about a shaft 75 in order to enhance accurate paper positioning. The auxiliary tray 72 has an inclined surface 72*a* for forcing the paper toward the upstream side in the direction of paper discharge.

Referring again to FIG. 2, the finisher 4 has a height $H_1$ smaller than a height $H_2$ customary with the conventional finisher. The finisher 4 is mounted to the apparatus 1 with its bottom supported by a generally L-shaped bracket 80 affixed to the apparatus body 2. In this condition, a space 84 is formed between the bottom of the finisher 4 and a floor 82 on which the apparatus 1 is situated. A leg 80*a* having a screw type level adjusting function extends out from the bottom of the bracket 80 and allows the height of the finisher 4 above the floor 82 to be adjusted.

A tray 48 extends out from the finisher 4. A stapler 50 for stapling a stack of papers and a lifting mechanism 52 for lifting the stapled stack to the tray 48 are arranged in the finisher 4. The paper introduced into the finisher 4 is conveyed through a path R6 to a finishing position T where the stapler 50 can operate. The papers stapled by the stapler 50 are driven out via a path R7. The path R6 is substantially horizontally connected to the route R5 of the transfer conveying means 6.

A path selector 54 is positioned at the downstream side of the path R6. In a staple mode, papers sequentially brought to the path R6 are steered by the path selector 54 to the path R7 and stacked and positioned on the path R7. After the stapler 50 has stapled the papers, the lifting mechanism 52 discharges the stapled papers along the path R7. The path R6 merges into a path R8 assigned to direct paper discharge. When stapling is not effected, the above path selector 54 steers the papers to the path R8.

As shown in FIG 2, the path R6 has a length of substantially $L_2$ noticeably smaller than the length $L_1$, of the conventional finisher shown in FIG. 1. This successfully reduces the possibility of a paper jam in the finisher 4 and reduces the paper discharge time, i.e., operation time. Also, the space 84 below the finisher 4 is available for e.g., boxes storing papers, toner cartridges and other supplies.

Further, the path R7 of the finisher 4 and therefore the finishing position T is higher in level than the conventional one. Therefore, the height S of the tray 48 above the floor 82 is great enough for the operator to pick up the papers easily in a natural position. In addition, the finisher 4 is small size and reduces the production cost.

Figure 4:
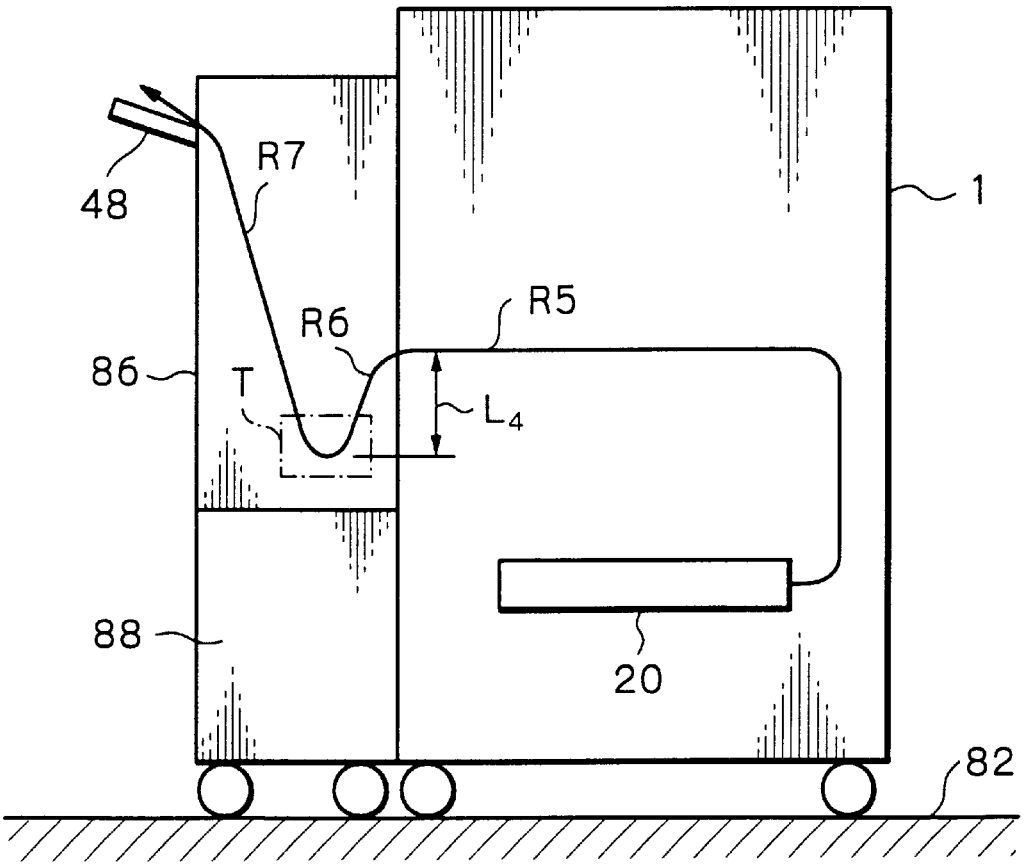
FIG. 4 shows an alternative embodiment of the present invention.

An alternative embodiment of the present invention will be described with reference to FIG. 4. In FIG. 4, the same structural elements as the elements shown in FIG. 2 are designated by like reference numerals and will not be described in order to avoid redundancy. As shown, a finisher 86, like the conventional finisher 100, is a floor type finisher, but its path R7 is positioned at a higher level than the conventional path. A box (also referred to as a storage unit) 88 for accommodating, e.g., supplies is formed integrally with the bottom of the finisher 86. One side of the box 88 is openable in order to load and unload the box 88 with supplies, although not shown specifically. The stapler and lifting mechanism described in relation to the previous embodiment are also included in the finisher 86, although not shown specifically.

In FIG. 4, the path R6 has a length of substantially $L_4$ also noticeably smaller than the length L1 of the conventional path. The illustrative embodiment therefore achieves the same advantages as the previous embodiment.

The conventional finisher shown in FIG. 1 may also be increased in height in order to form a portion equivalent to the box 98, FIG. 4, at its top. Such a position, however, would aggravate the operator's labor because papers and other supplies are heavy and, moreover, would degrade the appearance of the entire finisher. In addition, when the operator puts a used toner cartridge in the above portion of the finisher, toner is apt to drop onto the tray.

As stated above, the above embodiments achieve various unprecedented advantages, as enumerated below.

(1) A path for conveying a stapled paper stack is located at high level so as to reduced the length of a path preceding the above path. This successfully reduces the possibility of a paper jam in the finisher and operation time.

(2) A tray included in the finisher is located at a high level in accordance with the height of the path assigned to a stabled paper stack. The tray can therefore be located at a position allowing the operator to pick up papers in a natural position.

(3) The short path limits a location where a paper jam may occur and thereby facilitates the removal of a jamming paper.

(4) A space is available between the bottom of the finisher and the floor on which the image forming apparatus is situated. The space may be used for various purposes, e.g., for putting boxes loaded with papers, toner cartridges and other supplies.

(5) Even when the finisher is implemented as a floor type finisher, a portion for accommodating supplies is available at the bottom of the finisher. Such a portion is convenient to deal with and does not deteriorate the appearance of the entire finisher.

Figure 5:
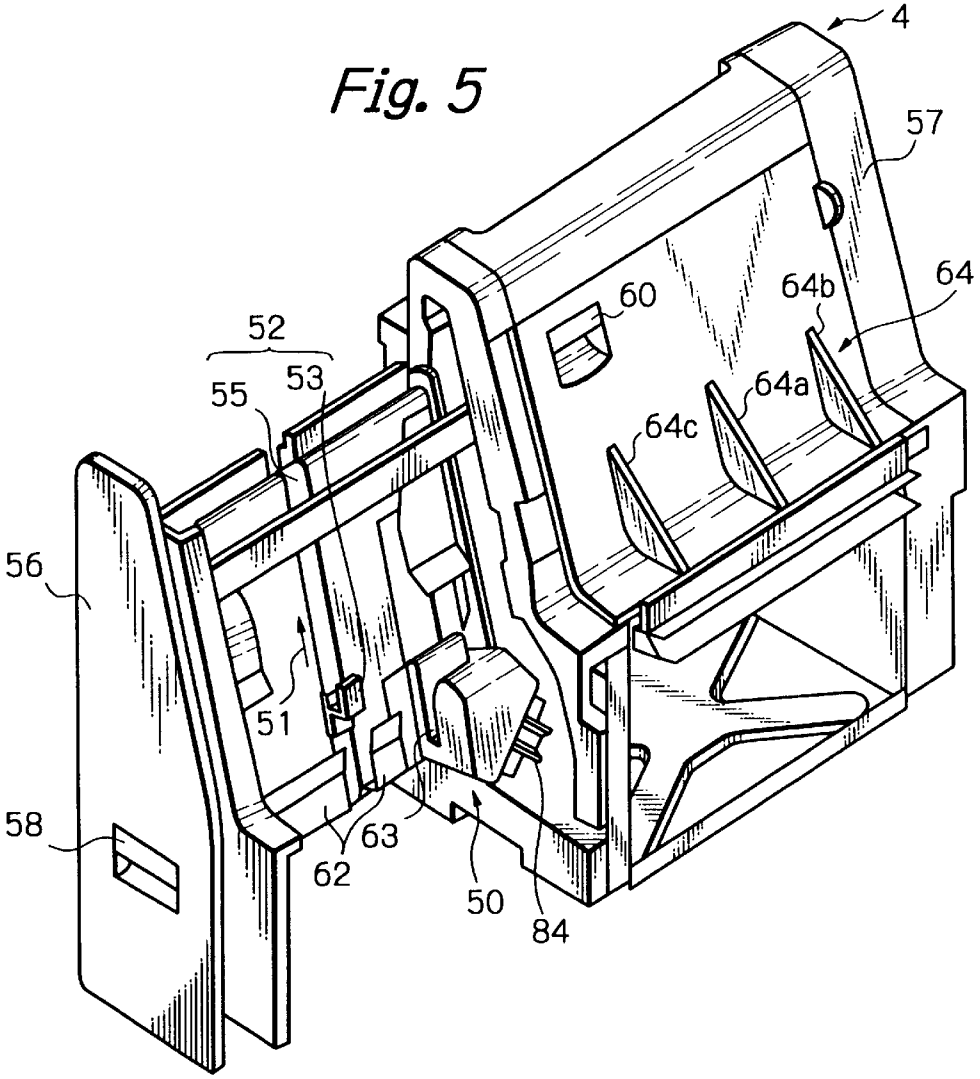
FIG 5 is a perspective view showing the internal arrangement of a finisher shown in FIG. 4.
Figure 6:
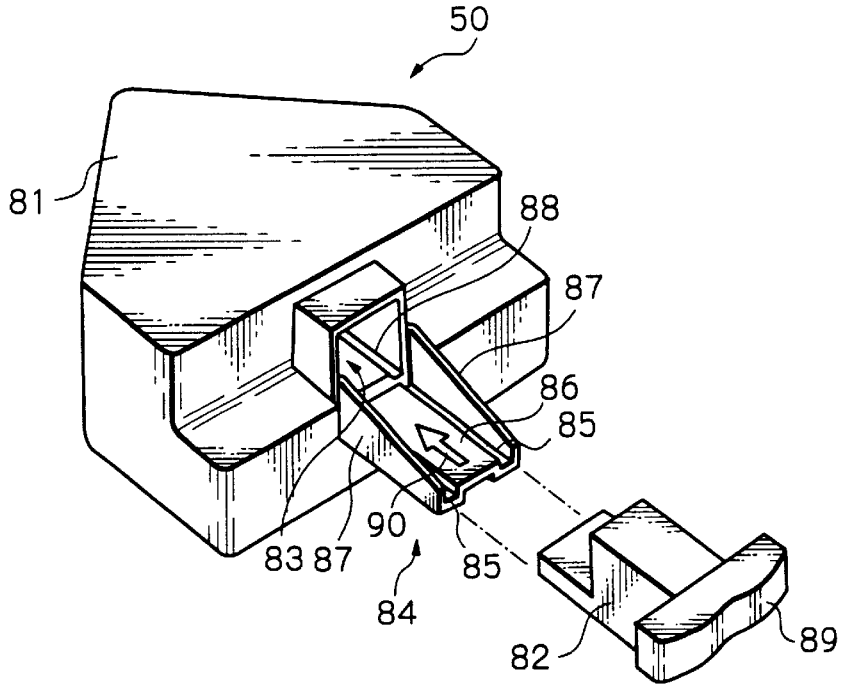
FIG 6 is a perspective view of a stapler included in the finisher shown in FIG. 5.
Figure 7:
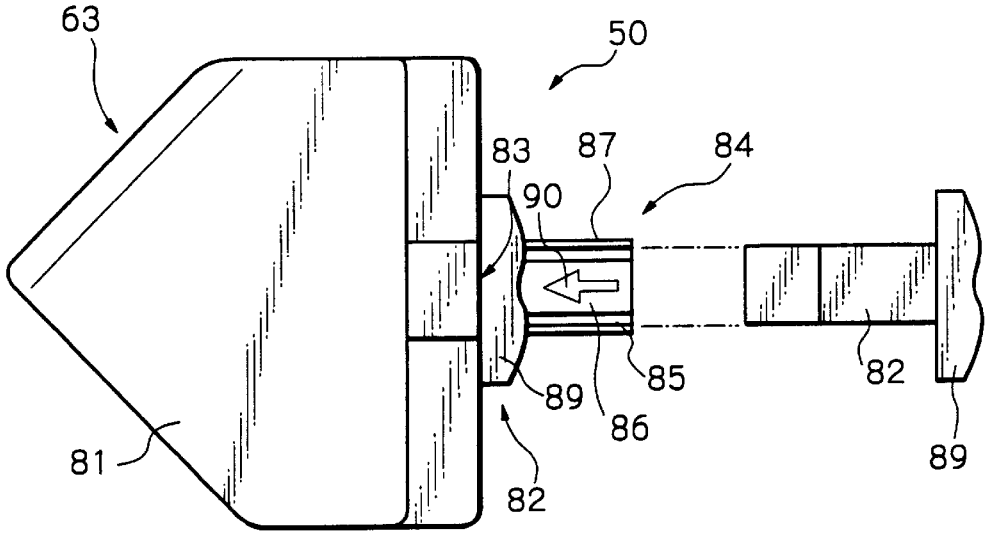
FIG. 7 is a plan view showing how a staple cassette included in the stapler of FIG. 6 is mounted and dismounted.

FIGS. 5–7 show another alternative embodiment of the present invention. Because this embodiment has generally the same construction as the previous embodiments, reference will also be made to FIGS. 2 and 3 for the following description.

As shown in FIGS. 2 and 5, the finisher 4 includes a rack 62 (FIG. 5) for temporarily receiving the papers sequentially steered by the path selector 54 into the route R7. A stapler 50 staples a preselected number of papers stacked in the rack 62. Discharging means 52 lifts the papers stapled by the stapler 50 upward to the tray 48. The discharging means 52 has a belt 55 rotatable in the direction indicated by an arrow 51 and a hook 53 affixed to the belt 55. The hook 53 is movable together with the belt 55 while catching the lower and of the paper stack stapled by the stapler 50, thereby lifting the paper stack toward the tray 48. The stapler 50 includes a recess 63 aligned with the rack 62 and staples the paper stack positioned in the recess 63.

As shown in FIG. 6 specifically, the stapler 50 includes a body 81 and a staple cassette 82 removable from the body 81 and loaded with staples. The staples are sequentially fed from the staple cassette 82 to the body 81 in the conventional manner. The body 81 is formed with an opening 89 for receiving the staple cassette 82 and a guide 84 extending out from the opening 83. The staple cassette 82 is guided by the guide 84 when pushed into the opening 83.

The guide 84 is made up of a bottom 86 and a pair of side walls 87 spaced from each other by a distance substantially equal to the size of the opening 83. The side walls 87 sequentially increase in height toward the opening 83, as illustrated. The upper surface of the bottom 86 is substantially flush with the bottom of the opening 83 and formed with a pair of rails 85 at both sides thereof. The rails 85 mate with the bottom of the staple cassette 82 and allow the cassette 82 to slide thereon into or out of the body 81. A pair of channels 88 are formed in the bottom of the opening 83 and contiguous with the rails 85. An arrow 90 is printed or otherwise provided on the bottom 86 In order to show the direction in which the staple cassette 82 should be inserted into the body 81.

As shown in FIG. 5, the guide 84 protrudes from the body 81 such that the operator can see the end of the guide 84 when opened the finisher 4 for loading the body 81 with the staple cassette 82. In the illustrative embodiment, the operator can see not only the guide 84 but also the arrow 90 and can therefore easily determine that the guide 84 is contiguous with the opening 83 when loading the body 81 with the staple cassette 82.

The portion of the stable cassette 82 storing the staples has a width substantially equal to the distance between the side walls 87. This portion of the cassette 82 is formed with ridges, not shown, capable of mating with the rails 85 on its under side. A pull 89 extends out from the rear top of the above portion of the cassette 82 and has a greater width than the other portion of the cassette 82. The pull 89 is configured such that it rests on the top edges of the side walls 87 and, as shown in FIG. 7, contacts the edge of the opening 83 only when the cassette 82 is fully inserted in the body 81 in an expected position. When the operator inserts the cassette 82 upside down by accident, the pull 89 abuts against the top edges of the side walls 87 and cannot be inserted into the body 81. Moreover, the operator, noticing the bottom ridges of the cassette 82, will readily see that the ridges should mate with the rails 85. The cassette 82 is therefore surely prevented from being inserted into the body 81 upside down. In addition, a stepped portion surrounding the opening 83 allows the operator to easily nip the pull 89 and facilitates the removal of the cassette 82 slightly firmly received in the body 81.

In operation, when a staple mode is selected on, e.g., an operation panel, the route R7 is selected in order to deliver consecutive papers to the finisher 4. After the trailing edge of each paper has moved away from the path selector 54, the paper drops due to gravity inn switch-back fashion and has its trailing edge received in the rack 62 and recess 63 aligned with each other. When a preselected number of papers have been positioned in the rack 62 and recess 63, the stapler 50 staples one corner of the paper stack. Subsequently, the discharging means 52, i.e., the hook 53 catches the bottom of the stapled paper stack and lifts it. As a result, the stapled paper stack is driven out to the tray 48 via the route R7.

When the stapler 50 runs out of the staples, a message for urging the operator to replenish staples is displayed on the operation panel. In response, the operator pulls out the side cover 56 by using the catch 58 to thereby open the finisher 4, and then removes the staple cassette 82 from the body 81 by nipping the pull 89. After loading the cassette 82 with staples, the operator slides the cassette 82 into the body 81 as indicated by the guide 84. Finally, the operator pushes the side cover 56 into the finisher.

If desired, the guide 84 may be provided on the apparatus body 2, more specifically the finisher 4, supporting the stapler 50. Because the stapler 50 is movable along the side edge of the paper stack in a conventional manner, it can staple any desired position of the paper stack other than the corner. Further, the guide 84 may be positioned such that the operator can see the entire guide 84.

As stated above, the illustrative embodiment has the following advantages.

(1) The guide guides the staple cassette into and out of the stapler body alone. Such a simple configuration insures the accurate insertion and removal of the staple cassette.

(2) The guide provided on the stapler body can be molded integrally with the stapler body and therefore reduces the number of parts while making it needless for the operator to position the guide relative to the stapler body. This also insures the accurate insertion and removal of the staple cassette.

(3) The guide provided on the apparatus body supporting the stapler body enhances design freedom and allows the stapler body to be replaced. This additionally insures the accurate insertion and removal of the staple cassette.

(4) The guide protrudes such that the operator can see at least its and when mounting or dismounting the staple cassette to or from the stapler body. The operator can therefore easily see the position of the stapler. Particularly, the operator can start mounting the staple cassette after abutting the cassette against the end of the guide. This promotes easy operation and insures the accurate mounting and dismounting of the cassette despite the simple configuration.

(5) The bottom of the staple cassette slides on the guide while mating with the rails formed on the guide. The rails therefore further promote easy operation and insures the accurate mounting and dismounting of the staple cassette.

Various modifications will become possible for those skilled in the art after receiving the teachings of the presert disclosure without departing from the scope thereof.

What is claimed is:

1. A finisher for an image forming apparatus, said finisher comprising:

a first path for conveying consecutive papers before finishing to a finishing position; and a second path for discharging a stack of papers after finishing through an outlet of said finisher;

wherein a substantial portion of said second path is positioned at a level higher than an inlet of said first path such that said first path has a length shorter than a preselected length, and wherein said first path extends in a substantially horizontal manner from said inlet to a discharge of said first path into the finishing position.

2. A finisher as claimed in claim 1, wherein said finisher has a dimension smaller than a preselected dimension in a direction of height, whereby a space is available between a bottom of said finisher and a floor on which the apparatus is situated.

3. A finisher as claimed in claim 1, wherein said finisher stands upright on a floor on which the apparatus is situated and wherein said finisher includes a bottom portion having a storage unit.

4. A finisher for an image forming apparatus, said finisher comprising:

a first path having an inlet adapted to receive a sheet from the image forming apparatus and discharge the sheet at a finishing position; and a second path configured to carry a stack of papers discharged from said finishing position to an outlet of said finisher, wherein a substantial portion of said second path is positioned at a level higher than said inlet of said first path such that said first path has a length shorter than a preselected length, and wherein said first path extends in a substantially horizontal manner from said inlet to a discharge of said first path into the finishing position.

5. A finisher as claimed in claim 4, wherein said finisher has a dimension smaller than a preselected dimension in a direction of height, whereby a space is available between a bottom of said finisher and a floor on which the apparatus is situated.

6. A finisher as claimed in claim 4, wherein said finisher stands upright on a floor on which the apparatus is situated and wherein said finisher includes a bottom portion having a storage unit.

* * * * *